US006478485B1

(12) United States Patent
Niestrath

(10) Patent No.: US 6,478,485 B1
(45) Date of Patent: Nov. 12, 2002

(54) PROCESS AND APPARATUS FOR DECORATING ARTICLES

(75) Inventor: Hans-Dieter Niestrath, Hiddenhausen (DE)

(73) Assignee: Werner Kammann Maschinenfabrik GmbH, Bünde (DE)

( * ) Notice: Subject to any disclaimer, the term of this patent is extended or adjusted under 35 U.S.C. 154(b) by 0 days.

(21) Appl. No.: 09/459,233

(22) Filed: Dec. 10, 1999

(30) Foreign Application Priority Data

Sep. 30, 1999 (DE) ..... 199 46 823

(51) Int. Cl.[7] ..... B41J 2/315

(52) U.S. Cl. ..... 400/120.07; 101/483; 101/484; 101/35; 101/40.1; 347/104; 358/1.1

(58) Field of Search ..... 400/76, 70, 120.07; 347/1, 37, 40, 43, 104, 171, 46; 101/483, 484, 40.1, 35; 358/1.1

(56) References Cited

U.S. PATENT DOCUMENTS

| | | | | |
|---|---|---|---|---|
| 3,509,981 A | | 5/1970 | Hylan et al. | |
| 4,012,676 A | | 3/1977 | Giebler | 318/135 |
| 4,081,723 A | | 3/1978 | Vetter et al. | 318/38 |
| 4,891,656 A | | 1/1990 | Kubelik | |
| 5,029,523 A | * | 7/1991 | Fields | 101/483 |
| 5,139,337 A | | 8/1992 | Fischer et al. | 356/358 |
| 5,204,697 A | | 4/1993 | Schmidlin | 346/159 |
| 5,239,318 A | | 8/1993 | Vannerson | |
| 5,488,399 A | | 1/1996 | Mitomi et al. | 347/43 |
| 5,803,628 A | | 9/1998 | Donahue | 400/279 |
| 5,808,646 A | | 9/1998 | Kitahara et al. | 347/104 |
| 5,898,446 A | * | 4/1999 | Moriyama | 347/46 |
| 5,915,858 A | * | 6/1999 | Wen | 400/120.07 |
| 5,947,361 A | | 9/1999 | Berger et al. | 226/92 |
| 5,967,676 A | * | 10/1999 | Cutler et al. | 101/35 |
| 6,000,781 A | * | 12/1999 | Akiyama et al. | 347/40 |
| 6,022,383 A | * | 2/2000 | Kuwabara et al. | 347/105 |
| 6,133,928 A | * | 10/2000 | Kayashima et al. | 347/171 |
| 6,139,126 A | * | 10/2000 | Ayata et al. | 347/43 |
| 6,165,406 A | * | 12/2000 | Jang et al. | 347/1 |
| 6,169,605 B1 | * | 1/2001 | Penn et al. | 358/1.1 |
| 6,312,123 B1 | * | 11/2001 | Codos et al. | 347/101 |
| 6,364,452 B1 | * | 4/2002 | Noyes et al. | 347/43 |

FOREIGN PATENT DOCUMENTS

| | | |
|---|---|---|
| DE | 19532724 A1 | 3/1997 |
| EP | 0 339 158 A2 | 11/1989 |
| EP | 0 427 163 A2 | 5/1991 |
| EP | 0 468 604 | 1/1992 |
| EP | 0 761 438 A2 | 9/1995 |
| EP | 0 851 306 A1 | 7/1998 |
| JP | 62-117768 A | 5/1987 |
| JP | 5-212857 A | 8/1993 |
| JP | 11034304 A | 2/1999 |
| WO | WO 82/04149 | 11/1982 |
| WO | WO92/13299 | 8/1992 |
| WO | WO94/16364 | 7/1994 |
| WO | WO 98/01793 | 1/1998 |
| WO | WO 98/51507 | 11/1998 |

* cited by examiner

*Primary Examiner*—Eugene H. Eickholt
(74) *Attorney, Agent, or Firm*—Drinker Biddle & Reath LLP

(57) ABSTRACT

In a process and apparatus for decorating an article, printing ink or electrostatic charges is or are applied in dependence on a digital program in dot form to the article carried by a holder, with individual dots going together to at least form a partial pattern or image. In the case of the latent pattern formed by electrostatic charges, it is then brought into contact with ink particles to form the decoration. In both cases the article is transported along a transportation path through at least one print station provided with an inkjet print head or an ionographic print head, the print head being controllable in dependence on the digital program. The individual nozzles or the electrodes of the respective print head are actuated in accordance with the digital program which is called up for example in dependence on the transportation movement of the article.

23 Claims, 5 Drawing Sheets

136
110
114a
116
122
I
120
Ia
168
Ib
170
142
128
111
126
124
110
118
143
146
134
114b
116
II
120
144
148
IIa
IIb
122

PROCESS AND APPARATUS FOR DECORATING ARTICLES

FIELD OF THE INVENTION

The invention concerns a process and apparatus for decorating an article, more particularly on the basis of a program containing digitised image information.

It will be noted at this juncture that when reference is made to decorating an article or to decoration, that term is not to be interpreted in a limiting sense. On the contrary the term decorate, decoration and so forth is to be interpreted in its broadest sense, for example in such a way as also to embrace not just images but any other graphics, description, other text, digits, numbers and the like. Similarly the term article is intended to embrace any form of article to which the process and apparatus according to the invention can be applied, one such example thereof being a CD, as well as credit cards, telephone cards and the like.

BACKGROUND OF THE INVENTION

Nowadays the procedure for printing on individual articles such as CDs, credit cards, telephone cards and similar articles is implemented without exception with the use of processes in which the printing inks are applied to the article to be decorated by means of at least one transfer element and the transfer element is of a configuration corresponding to the print image to be transferred or is provided with the print image to be transferred. The former case can involve for example the use of a screen printing arrangement in which the printing ink is applied to the article by means of a squeegee or doctor, through a stencil which is provided with the print image. The second case frequently involves the use of the offset printing process in which the printing ink corresponding to the print image to be produced is firstly applied to the printing blanket on a cylinder and from there to the article.

A common aspect of all those processes which, for transfer of the ink on to the article to be printed, require contact between the article and the transfer means, is that the printing mechanisms must be of such a configuration as to correspond to the print image to be produced on the article, that is to say for example they must be provided with print blocks or plates or stencils of a suitable configuration. The consequence of this is that, upon a change in the articles to be printed upon and thus upon a change in the print image to be applied, the printing mechanism has to be appropriately converted, that is to say, it has to be fitted with a new screen printing stencil or a new plate cylinder. That conversion procedure can demand a considerable amount of time, during which production ceases, particularly when the apparatus has a plurality of printing mechanisms, as is the case for example when producing a multi-color print image. Furthermore, with the machines which are usually employed nowadays, the conversion procedure, which includes the necessary step of adjusting and setting the printing mechanisms to the print image of the respectively following batch of articles to be printed upon, requires operators of a very high level of skill and training if the machine is to produce a high-quality print image after conversion. The problems which arise in such a context can give rise to major disadvantages not least for the reason that in many cases, for example when dealing with CDs, telephone cards and credit cards, very small batch numbers frequently have to be printed upon. Batch sizes of only several hundreds of CDs or telephone cards are not uncommon. At the same time the demands made in terms of the quality of the print image are becoming greater and greater.

SUMMARY OF THE INVENTION

An object of the present invention is to provide a process for decorating an article, which makes it possible to produce high-quality print images, with a high production capacity, while at the same time apparatus conversion times can be so short that it is possible to economically decorate even very small batch numbers.

Another object of the present invention is to provide an apparatus which while being of a simple structure and involving a simple mode of operation can produce high-quality print images with a high rate of item production, together with a capability for rapid conversion from one printing mode to another.

Still another object of the present invention is to provide a process for printing on an article, which affords an enhanced degree of adaptability to varying operating and production requirements.

In accordance with the principles of the present invention, in a first aspect of the process, the foregoing and other objects are attained by a process for decorating an article in which printing ink is applied from nozzles in dot form to the article which is carried by a holder, in dependence on a program which contains digitised image information, and individual ink dots go together to form at least a partial print image. The holder carrying the article to be printed upon is moved along a transport path through at least one print station provided with a print head having the nozzles which are controllable in dependence on the program. At least a part of the nozzles is actuated in accordance with the program during the transportation movement of the article, and the holder for the article is transported using a linear motor along the transportation path.

As will be seen in greater detail from the description hereinafter of preferred embodiments of the invention, this process in the first aspect of the invention can be considered as involving an inkjet process in combination with a program containing digital image information, for printing on individual objects, and makes it possible to produce print images, including multi-color images, of very high quality. It is also possible to achieve a high production rate. This is also to be attributed to the fact that printing on the article can take place during the transportation movement through the printing machine, which is necessary in any case. The use of a linear motor contributes considerably to achieving a good quality of print image as the linear motor permits accurate coordination of the speed of transportation movement and the printing operation in the respective print station.

Further in accordance with the principles of the present invention, in a second aspect of the process of the invention, the foregoing and other objects are attained by a process for decorating an article in which firstly in dependence on a program including digitised image information, a latent image which is formed by electrostatically charged regions on a dielectric surface of the article to be decorated and which corresponds to the decoration to be applied is produced by charge transfer, whereupon the surface is brought into contact with ink particles of opposite charge, in order thereby to produce a decoration corresponding to the latent charge pattern. The article is moved along a transportation path through at least one station provided with an ionographic print head which is controllable in dependence on the program and in which charge carriers are generated by means of electrodes. A stream of charge carriers of the desired polarity is transferred on to dielectric regions of the surface of the article to form a latent pattern. The holder for the article is transported using a linear motor along the transportation path.

As will be seen in greater detail hereinafter, in that procedure therefore the ionographic print head in which the charged particles are generated, which are then transferred in the form of an ion stream on to the dielectric surface to form the latent pattern, by virtue of the voltage drop between the print head or electrodes therein and the article to be decorated, is controlled in dependence on the digital image information-containing program. In this respect, as background information, attention is directed to U.S. Pat. No. 4,891,656, the disclosure of which is hereby incorporated hereinto as appropriate by virtue of reference thereto.

Further in accordance with the invention, in a first aspect of the apparatus, the foregoing and other objects are attained by an apparatus for decorating an article using a process in which printing ink is applied in dot form from nozzles to the article which is carried by a holder, in dependence on a program which includes digitised image information, with individual dots going together to form at least a partial print image. The apparatus includes at least one print station, at least one transportation path along which the article carried by the holder is transported through the at least one print station, with the at least one print station being provided with at least one print head which is controllable by the program and the individual nozzles of which are actuable by means of pulse control in accordance with the program. A linear motor is operative to transport the articles along the transportation path.

Further in accordance with the invention, in a second aspect of the apparatus, the foregoing and other objects are attained by an apparatus for decorating an article using a process in which a dielectric surface is provided, in dependence on a program containing digitised image information, with an electrostatic charge representing a latent pattern corresponding to the decoration to be applied, and is thereafter brought into contact with oppositely charged ink particles in order thereby to produce the decoration. The apparatus includes at least one transportation path along which the article to be decorated which is carried by a holder and which is provided with the dielectric surface is transported, and at least one station in which the electrostatic charge pattern is applied has at least one ionographic print head controllable by the program for producing charge carriers of the desired polarity. The print head has electrodes by which the charge carriers are generated and which are actuable in dependence on the program. The apparatus further includes a linear motor for transportation of the articles along the transportation path.

It will be seen therefore that in both aspects of the process and apparatus according to the invention, application of the decoration to an individual article is implemented in a contact-less manner so that, upon a change in the decoration or the print image to be applied, it is only necessary to change the program for controlling the respective print head or image-forming unit. It is also readily possible to change the program from one article to the following article, in which respect such a change can also be suitably programmed, so that for example there is the possibility of printing on for example credit cards with a uniform decoration, while however changing the card number and the name of the card holder from one card to the next. When making a change in the complete program, for example when changing over from one printing batch to another, it is sufficient for the operator to replace one program carrier by another so that sample prints, if necessary at all, are only required in a very low number, before the normal production run can be initiated.

As the movements of the article to be printed upon on the one hand and the execution of the print program in the respective print station on the other hand must be synchronised, a preferred feature of the invention provides operating in such a way that the transportation movement of the article or the holder carrying same is controlled in dependence on the execution of the program, as this generally permits a greater degree of flexibility in regard to the configuration of the program, for example in such a way that the movement of the article during the printing operation can be decelerated or accelerated or the article can be brought to a halt so that it is possible to apply to a specific small region, more ink in the form of a plurality of successive ink droplets or more densely disposed charge points.

It is however also possible to operate in such a way that for example the article is transported through the process and apparatus at a constant speed and the program in the print station is called up in dependence on the movement of the article.

The holder for the article can be carried by the primary portion of the linear motor. That affords the advantage that, when there are a plurality of holders and thus a plurality of transportation carriages, for simultaneous treatment of a plurality of articles in the printing machine, the movements of the individual transportation carriages can be controlled independently of each other, without involving a high level of complication and expenditure. The independent control of the movement of the carriages may be of significance for the reason that, particularly in the case of multi-color printing machines, the articles and thus also the holders carrying them pass through a plurality of stations in the machine and different speeds, residence times and the like may be required in the individual stations. The option of mutually independently controlling the individual holders or the carriages carrying same, in regard to the movements thereof, can contribute to achieving a high production capacity. It will be appreciated however that the converse arrangement in which the holder is carried by the secondary portion of the linear motor is also a possible option. It will be noted however that this may involve a markedly higher level of structural and circuitry complication and expenditure if the individual carriages are to be controllable independently of each other in regard to their movements. The movements of the individual carriages outside the at least one print station and any further treatment stations that may be involved can also be controlled in dependence on a program.

Further objects, features and advantages of the invention will be apparent from the description hereinafter of preferred embodiments of the invention.

DESCRIPTION OF THE PREFERRED EMBODIMENTS

Figure 1:
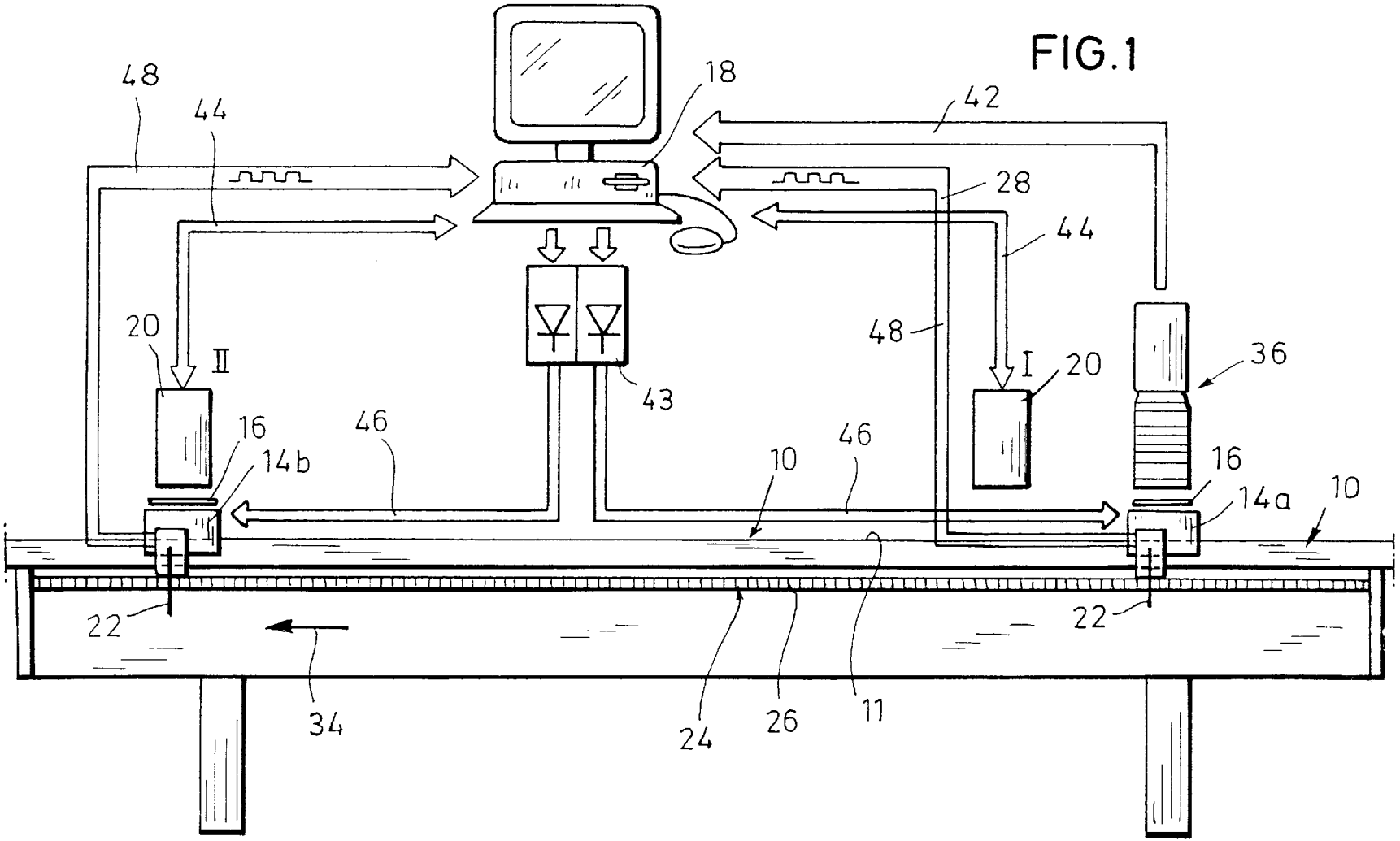
FIG. 1 is a diagrammatic overall view showing major parts of an apparatus for decorating individual articles, using an inkjet head.
Figure 2:
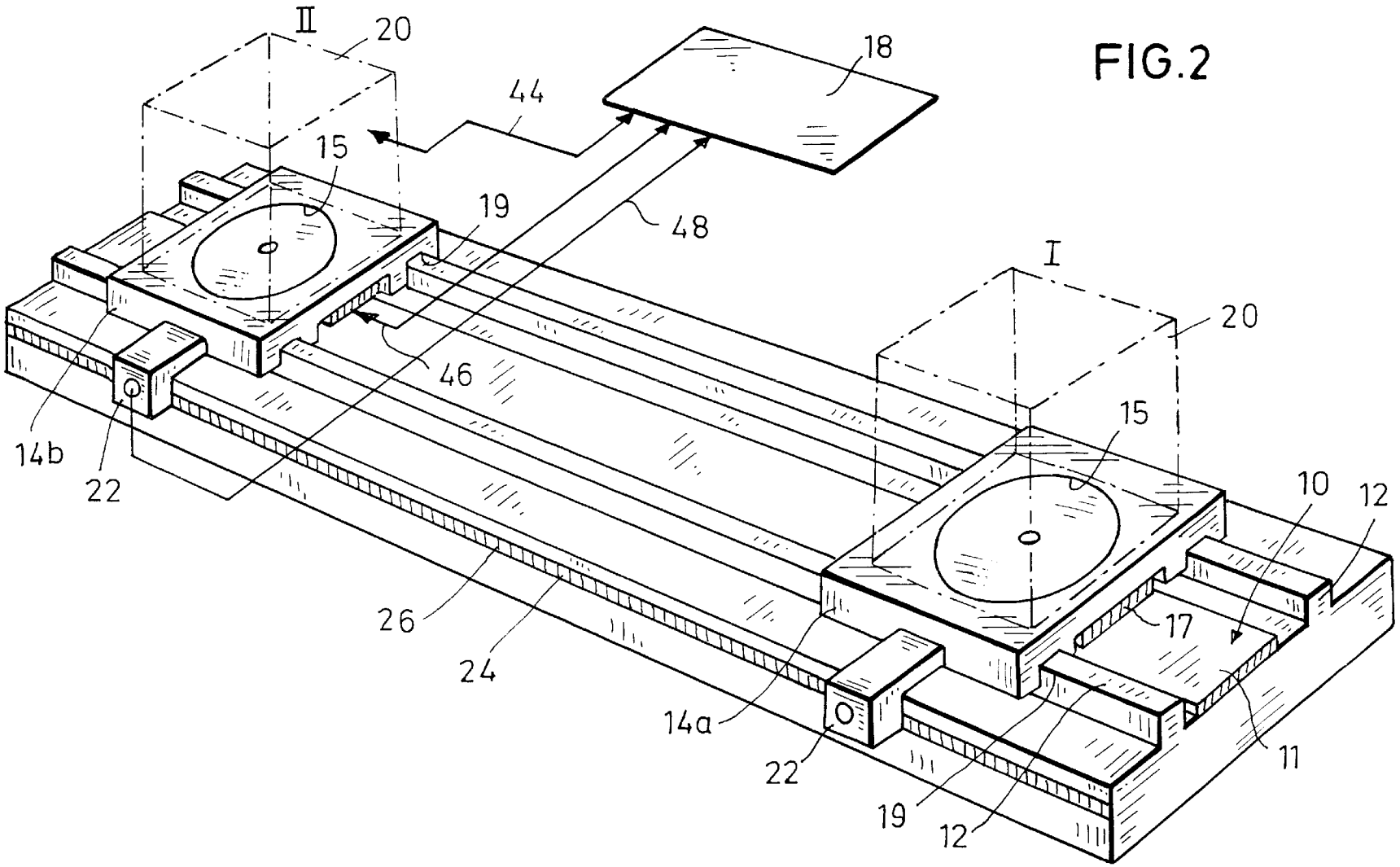
FIG. 2 is a perspective view showing the article-transportation path with a linear motor.
Figure 3:
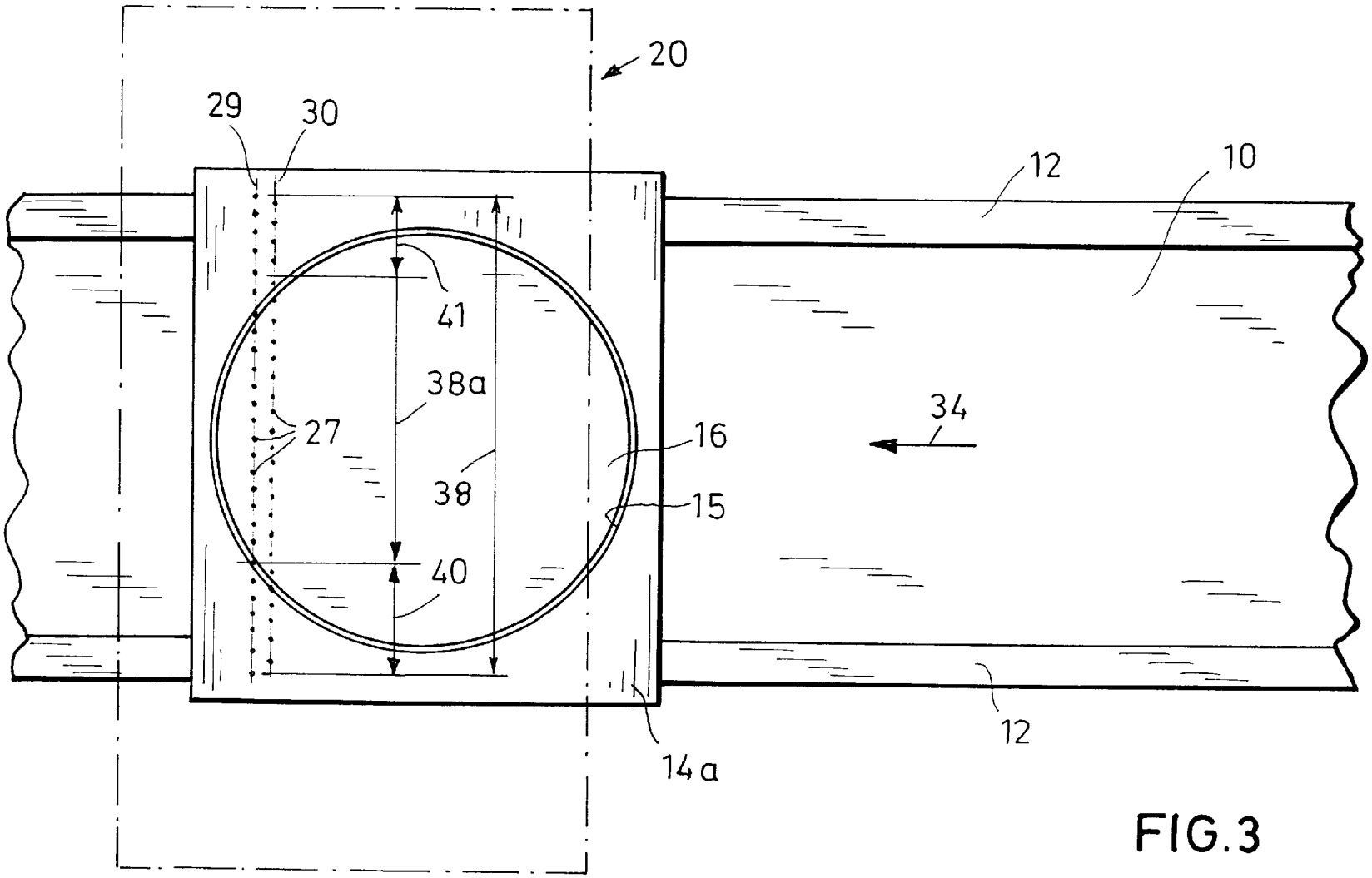
FIG. 3 is a diagrammatic view of an inkjet print head with article to be printed upon thereby.

Referring firstly to FIGS. 1 through 3, shown therein is an apparatus according to the invention comprising a transportation path which is generally identified by reference numeral 10 and which is provided with a rail 11 of a linear motor and two guides which are indicated by reference numeral 12 more specifically in FIG. 2 and which are parallel to the rail 11. The embodiment shown in FIG. 1 has only one finite linear rail portion with which first and second stations as indicated at I and II are operatively associated, at least one of the stations being a print station. In a departure from the structure shown in FIG. 1, the rail 11 and the transport path 10 may also be for example in the form of a circle, an ellipse or yet another shape, and may be in the form of an endless transport path extending in a horizontal plane.

In the embodiment shown in FIGS. 1 through 3, associated with the rail 11 are first and second transportation carriages or sliders 14*a*, 14*b* as movable components of the linear motor. The carriages 14*a*, 14*b* are each provided on their top side with at least one receiving means indicated at 15 in FIG. 2, for receiving a respective article 16 to which decoration or printing is to be applied. The structure and the mode of operation of a linear motor are conventional knowledge in the art so that they do not need to be described in greater detail herein. It will be appreciated that the invention utilises the linear motor drive as a means for transporting the articles through the at least one print station I and/or II, and, in particular when the apparatus has a plurality of print stations, also for bridging over the distances between the print stations and between the print stations and possibly additional other stations that may also be provided such as handling, treatment or checking stations.

Normally the primary portion of the linear motor which has the three-phase winding 17 will form or carry the respective carriage 14*a*, 14*b* while the rail 11 with the magnets or the like serves as the secondary portion of the linear motor. It is however also possible to adopt the reverse arrangement. Which of the possible design configurations is given preference is not a matter of basic significance from the point of view of the present invention.

As can be clearly seen from FIG. 2, each carriage 14*a*, 14*b* is provided at its underside with first and second openings 19 in the form of grooves extending therethrough. Engaging into each of the openings 19 is one of the guides 12 in the form of guide bars, which also carry transverse forces occurring between the rail 11 and the respective carriage 14*a*, 14*b*, and provide for precise lateral orientation of the respective carriage 14*a*, 14*b*.

In the structure shown in FIGS. 1 through 3, printing is applied to the respective article 16 carried on the carriages 14*a*, 14*b* by means of an inkjet process. For that purpose, the apparatus is provided with a central computer as indicated at 18 in FIG. 1, which controls nozzles indicated at 27 in FIG. 3 of the individual inkjet print heads 20 in accordance with a program which contains digitised image information and which is stored in the computer 18. The article 16 to which decoration is to be applied by a printing operation is moved along the transportation path 10 during the printing procedure. Each carriage 14*a*, 14*b* is provided with at least one sensor indicated at 22 in FIGS. 1 and 2, which operates in a contact-less manner and which co-operates with a continuous measuring bar or rail 24 of a length measuring system which extends parallel to the transportation path 10. The measuring rail 24 is provided with a plurality of measuring points indicated at 26 in FIGS. 1 and 2, which trigger off pulses in the sensor 22. The measuring points 26 are arranged at a very small spacing of for example $1\mu$ from each other.

Reference will now be made more particularly to FIG. 3, to describe the basic structure of a print head of the apparatus according to the invention. The nozzles 27 from which printing ink is expelled in droplet form towards an article 16 to be decorated are arranged in one or more rows above the article 16, in such a way that the spacing between two adjacent nozzles 27 of a row thereof, as indicated at 29 and 30, is no greater than the maximum diameter of the application of ink which is formed on the article 16 from the respective droplet. In general, a print head of that kind is provided with at least two rows of nozzles 29, 30 which are arranged one behind the other perpendicularly to the direction of transportation movement 34 of the article 16, while the individual nozzles 27 of those two rows 29, 30 are arranged in mutually displaced relationship transversely with respect to the direction of transportation movement 34 by for example half the dimension of the spacing between two adjacent nozzles 27 of a row. The print head may also have more than two rows of nozzles. The number of rows of nozzles and the arrangement of the nozzles depends in essence on the quality of the print image to be produced, in which respect there will generally be a requisite that it must be possible to produce printing without any gaps, that is to say, it must be possible to apply the printing ink in such a way as to form a continuous covering thereof in the regions where that is required.

Actuation of the nozzles which are operated for example by piezoelectric means is implemented in a frequency-controlled mode, involving a given pulse sequence which corresponds to the program for the print image to be applied at the respective print station. The pulse sequence must be synchronised with the speed of movement of the article 16 and thus the carriage 14*a*, 14*b* carrying same in the printing operation.

Synchronisation of actuation of the nozzles 27 of the print head on the one hand and the movement of the respective carriage 14*a* or 14*b* on the other hand is achieved by way of the computer which co-ordinates actuation of the individual nozzles to achieve an application of ink which possibly covers a required surface area or portion and the movement of the respective article 16, in accordance with the operating program stored in the computer 18. The speed of the carriage 14*a*, 14*b* is controlled by way of the frequency of the power supply for the linear motor.

In the embodiment illustrated in the drawing, relative adaptation of the print head to the position of the article 16 on the co-ordinate axis which extends perpendicularly to the direction of transportation movement 34 is effected using a camera 36 which detects the article 16 carried by the receiving means 15 on the respective carriage 14*a*, 14*b*, in regard to its position, for example by reference to its contour or an image already applied as by printing to the article 16 or any other register marks. The actual position of the article 16, which is ascertained in that way, in a co-ordinate axis which is parallel to the direction of transportation movement 34, and in a co-ordinate axis which is perpendicular to the direction 34, is digitised and compared to a reference or target value which is stored in the computer 18. Any difference between the actual value and the reference value is extremely slight as it cannot be greater than the sum of the clearance or play which the article 16 has within the receiving means 15 and the clearance or play of the respective carriage 14*a* or 14*b* on the guide bars 12. It is therefore normally only fractions of a millimeter. However, precise relative orientation of the article 16 and the print head relative to each other also contributes to the quality of the print image to be produced.

In the embodiment illustrated in FIGS. 1 through 3, relative orientation of the article 16 transversely with respect to its direction of transportation movement 34 is implemented in such a way that those nozzles of each row of nozzles 29, 30 which are above the region of the article 16 which is to be provided with an application of printing ink in the respective print station I or II, can be made operative for the respective printing operation. For that purpose, the arrangement is such that the length of the rows of nozzles is somewhat greater than the width of the portion or part of the article 16, to which printing is to be applied by means of the respective print head. This means that, when the region on the article 16 to which printing is to be applied is for example of the maximum width as indicated at 38 in FIG. 3, the length of the rows 29, 30 of nozzles is greater than that maximum width 38. The procedure implemented is then such that, after the actual position of the article 16 and thus also the position of the part of the article 16 to which printing is to be applied has been established by way of the above-mentioned camera 36 and the computer 18, those nozzles 27 of the rows of nozzles, which are disposed above the part of the article 16 to which printing is to be applied, in the region of the width 38, are made operative for the printing procedure. The part of the rows of nozzles, which is made operative to carry out the printing procedure, is identified by reference 38*a* in FIG. 3. In the respective printing operation, only the nozzles within the portion indicated at 38*a* in the respective row of nozzles 29, 30 are actuated for expelling ink droplets to produce the application of ink to the article 16. The nozzles which are outside the width 38 of the part of the article 16 to which printing is to be applied, that is to say the nozzles which are in the end portions indicated at 40 and 41 respectively of the respective rows 29 and 30 of nozzles, do not take part in the printing operation as they are made inoperative.

Depending on the respective position that the articles 16 assume in the receiving means 15, it may be necessary for the portions 38*a*, 40 and 41 of the respective row 29, 30 of nozzles to be re-set in each printing operation. As a consequence, that means that the portion 38*a* of the operative nozzles 27 in each row is displaced laterally, that is to say transversely with respect to the direction of transportation movement 34, in dependence on the position of the article 16, in order to adapt the portion 38*a* in that way to the position of the part of the article 16, to which printing is to be applied.

Relative orientation of the article 16 and the print head relative to each other in the direction of transportation movement is effected after establishing the actual position of the article 16 and comparing same to the reference or target position, by calculating the number of pulses for the generally linear transport movement, the difference between the actual number of pulses and the reference number of pulses corresponding to the deviation between the actual position of the article from its reference position in the direction of transportation movement 34.

In regard to the number and size of the nozzles 27, it should be noted that the size of the dots applied to the article 16 by the ink droplets is approximately of the magnitude of a diameter of for example between 30 and 50$\mu$. The spacing between two nozzles in a row should be no greater than the maximum diameter of the dot of printing ink, which is formed on the article 16 by the ink droplets from a nozzle. The number of mutually parallel rows of nozzles in the direction of transportation movement 34 is determined on the basis of the need to form if necessary a continuous or closed layer of ink which covers the article in a continuous coating on the area thereof which is to be covered by the printing. Variable printing ink droplet sizes can possibly be achieved by a procedure whereby two or more droplets are expelled from the same nozzle in immediate succession, in which case then the speed at which the article 16 is advanced may possibly be reduced to zero.

In general, all nozzles in a row and a print head operate with the same printing ink.

More specifically, the decoration process according to the invention is implemented in such a way that firstly the respective transportation carriage 14*a*, 14*b* with the respective article 16 disposed thereon is moved into a position beneath the camera 36 so that the position of the article 16 can be suitably detected. The position of the article 16 within its receiving means 15 will thereafter not change as the article 16 is suitably held in its receiving means 15, for example by a reduced pressure or suction effect. If necessary the camera 36 can also be used at the same time to carry out an identity checking operation in order to ensure that the correct article 16 is disposed in the receiving means 15 of the transportation carriage 14*a* or 14*b* respectively.

The items of information regarding the position and identity of the article 16 in question are transmitted by way of an information channel or bus 42 to the computer 18 which by way of a further information channel or bus 44 actuates the print head 20 in each print station I, II, in such a way that a portion 38*a* of each row 29, 30 of nozzles and so forth, which corresponds to the position of the part of the respective article 16 to which printing is to be applied, is rendered operative. At the same time for example the carriage 14*a* of the linear motor can be moved in a direction towards the print station I, with actuation of the linear motor being effected by way of a frequency converter 43 which is connected by way of a line 46 to the respective carriage 14*a*, 14*b*, and the position and/or speed of movement of the respective carriage as at 14*a* are detected by means of the measuring system comprising the measuring rail 24 and the sensor 22, and are passed by way of an information channel or bus 48 to the computer 18 in which the information concerning the position and/or speed of the carriage 14*a* are used to regulate the movement of the carriage and therewith the article 16 carried thereby, in such a way that the movement is synchronised with the progress of the printing operation, that is to say actuation of the nozzles 27 of the print head 20, thereby affording the desired print image. It will be noted that the print image is frequently only a partial print image in the sense that two or more such generally different partial print images, each of which is applied to the article 16 at a suitably programmed print station using a respective printing ink or color, go together to form a generally multi-color overall print image. That means that each print station will normally have its own specific print program associated therewith.

The line 46 and the information channel 48 may form parts of a regulating circuit by which the speed of the respective transportation carriage 14*a*, 14*b* is kept as constant as possible, in particular during the printing operation, insofar as this can be brought into conformity with the progress of the printing program or the frequency of the print head. A variable speed of transportation movement during the printing operation is applied if the ink density on the article 16 is to be varied. That is implemented by way of the frequency converter 43 which is connected into the power feed to the linear motor formed by the transportation carriage and the rail 11, with the speed of the carriage being regulated by way of the frequency of the feed current to the motor. As a respective frequency converter is provided for each transportation carriage 14*a* and 14*b* respectively, it is possible for the transportation carriages to be controlled or regulated independently of each other, in respect of their speed of movement.

In that arrangement, the information channel 44 can also be used at the same time to send items of information from the respective print head 20 to the computer 18. Such items of information can concern for example the nature of the printing ink, that is to say for example its temperature and therewith also its viscosity, or other parameters.

FIGS. 1 and 2 show an apparatus having first and second print stations, with which a common transportation path 10 is associated. This means that, after the second partial print image has been applied in station II to the article 16 which is carried by the carriage 14*b* , that carriage 14*b* must firstly be further moved along in the direction of transportation movement 34 in order to provide space for the carriage 14*a* in the print station II, so that the article 16 carried by the second carriage 14*a* can be provided with the second partial print image. Multi-color printing will generally involve the use of more than two print stations, with different inks being applied to each respective article in all of the print stations.

A drying station which is not shown in the drawing can be provided downstream of at least one of the print stations I, II, as considered in the direction of transportation movement 34. In the drying station, the partial print image which has been applied to the article 16 at an upstream position is dried at least to such an extent that, when the next partial print image is applied, for example in the next following print station II, there is no longer any risk of the inks of the two partial print images running together or otherwise mixing with each other.

It will generally be desirable, as a departure from the view shown in FIG. 1, for the apparatus to have a transportation path comprising rail 11 and guides 12, which is of an endless configuration, consisting for example of two mutually parallel linear portions which are disposed in side-by-side relationship at a spacing from each other and which are connected together at their two ends for example by a respective semicircular portion with rail 11 and guides 12. It is possible for any number, that is to say more than two, of transportation carriages to be associated with such a transportation path. The carriages can be moved in freely programmable and mutually independent manner, for example in such a way that their operating movements include a brief stop for introduction of an article 16 into the receiving means and for removal of a printed article 16 from the receiving means 15, a slow-motion speed for any treatment operations to be carried out on a respective article 16, and the movement, already referred to above, through the print stations I, II and so forth at a speed which is possibly constant. As already mentioned above, in this latter aspect precise synchronisation with actuation of the nozzles of the print head is an important consideration.

As the highest degree of accuracy is required for the movements of the transport carriages in the print stations, it could be sufficient for the measuring rail 24 to be provided only in a portion-wise manner in which the print stations are disposed, so that a conventional transport means can be used to cover the free distances between the linear transport portions or the print stations. In general however, and in particular when using a relatively large number of transportation carriages in combination with a common rail, it will be desirable to provide a continuous measuring rail 24 in order to be able to monitor and if necessary control the movement of the individual transportation carriages, over the entire length of the transportation path 10.

Figure 4:
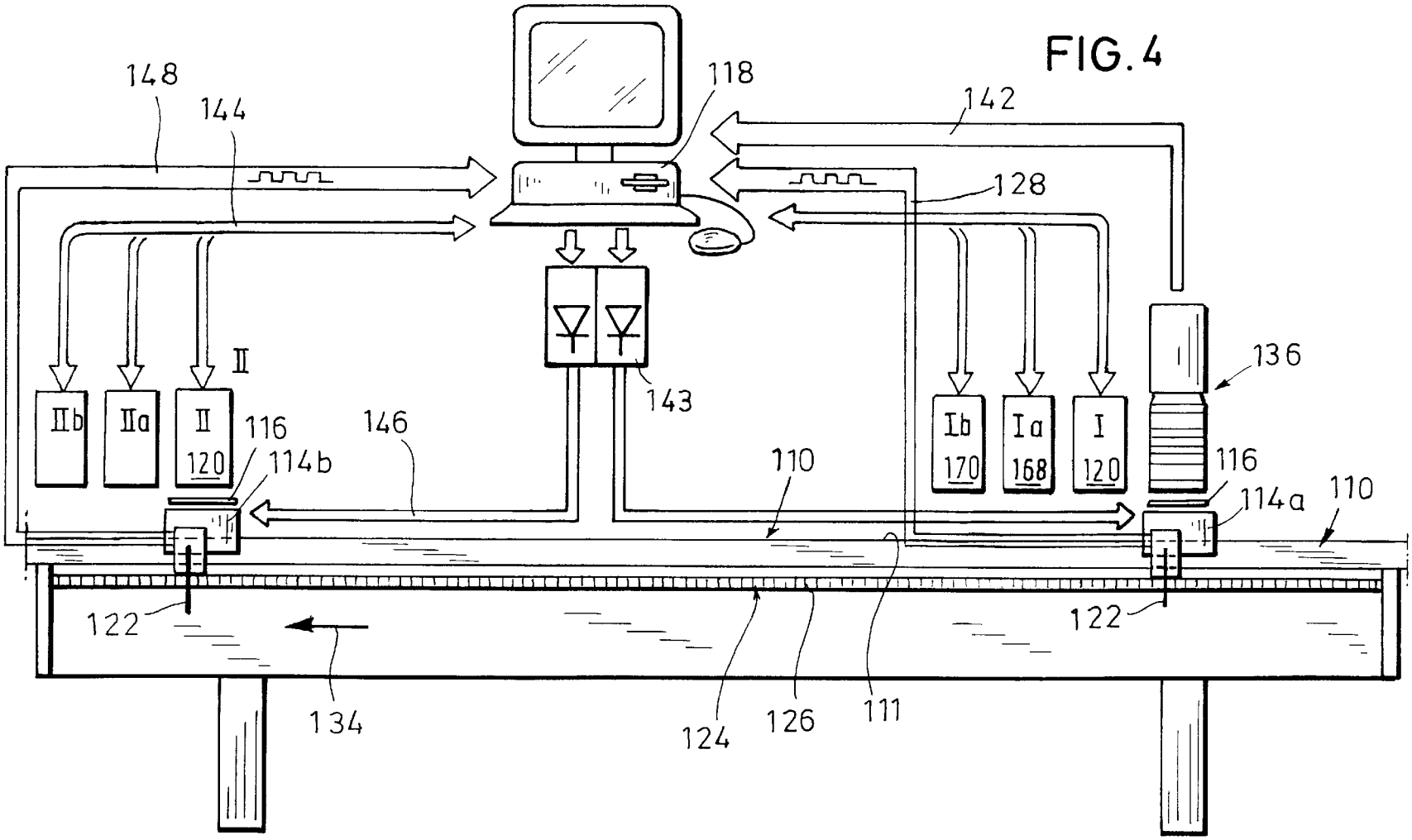
FIG. 4 is a view corresponding to FIG. 1 of a second embodiment using an ionographic print head.
Figure 5:
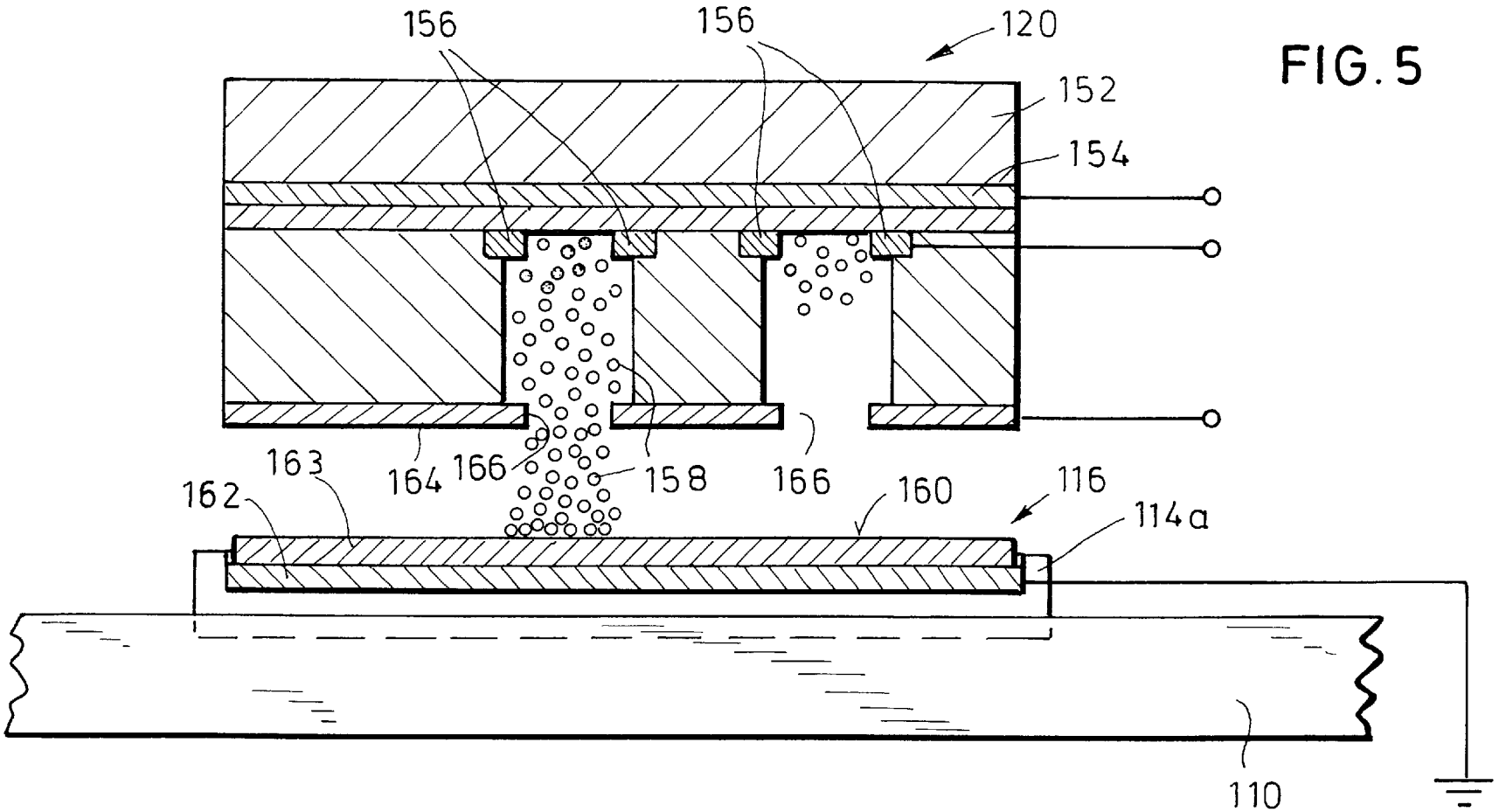
FIG. 5 is a diagrammatic view showing the structure of an ionographic print head.

Reference will now be made to FIGS. 4 and 5 to describe a further embodiment of the process and apparatus according to the invention. In FIGS. 4 and 5, in view of the general similarity of structure with the embodiment of FIGS. 1 through 3, the same or corresponding components are denoted by the same references but increased in each case by 100.

The major difference between the embodiment of FIGS. 1 through 3 and the embodiment of FIGS. 4 and 5 is that, instead of the inkjet print head, the apparatus uses an ionographic print head and the pattern of the respective decoration to be applied is firstly applied to the article 16 in the form of a charge pattern. Thereupon, printing ink in the form of a toner or in another suitable form is brought into contact with the corresponding electrostatically charged surface of the article. As the particles of the toner or printing ink in another form have a charge which is opposite to the charge at the surface of the article 16, representing a latent pattern, those particles cling to the charged regions of the surface of the article 16, thereby forming the respective decoration which can be a partial decoration in the sense that a plurality of such partial decorations go together to constitute the finished decoration.

The article which is provided with the decoration consisting of the application of printing ink can be subjected to a further treatment in order to remove superfluous printing ink which possibly also adheres to the non-charged regions of the surface of the article 16.

In a further step, if necessary, the printing ink forming the decoration can be fixed in the usual manner, for example by heating.

Finally, there is also the possibility of the article 16 bearing the print image being subjected to a further treatment in which any residual charge that may remain at the surface of the article 16 is removed. That residual charge can be neutralised for example by a corona effect. A plurality of such post-treatments can possibly be combined together, if required.

The above-described operating procedure is diagrammatically illustrated in FIG. 4. After an article 116 to which printing is to be applied for decoration purposes has been checked and monitored by the camera 136 and detected in respect of its position, the transportation carriage 114*a* with the article 116 thereon is transported into a position below the ionographic print head 120 of the station I, generally being in the form of a unit referred to as a cartridge. In the station I, the latent charge pattern is formed on the article 116 by the transfer of electrostatically charged particles on to the surface as indicated at 160 in FIG. 5 of the article 116. For that purpose, as shown in FIG. 5, the article 116 must be provided with an electrically conductive layer 162, over which there is a dielectric layer 163 whose surface 160 is provided with the charge pattern. The electrically conductive layer 162 is grounded by way of a line 168. The electrically conductive layer 162 which represents a base electrode in relation to the print head 120 can be formed for example in the case of a CD by the metallised coating thereon, in which case then special measures must be taken to ensure that the CD disposed in the receiving means 115, or the metallised layer 162 thereon, is conductively connected to the line 168 for grounding purposes. It will be appreciated that grounding can also be effected by way of the transport carriages 114*a* and 114*b* respectively. In the case of a CD, the dielectric layer 163 would then be applied to the metallised layer 162 thereof.

Reference will now be made to FIG. 5 to describe the basic structure of an ionographic print head 120. Disposed at the underside of a carrier layer 152 is a number of laterally displaced high-frequency lines 154 extending over the entire width of the region to be printed upon. The lines 154 are subjected to a high-frequency ac voltage, referred to as bursts, for the purposes of applying the charge pattern to the article 116 which is carried by the transportation carriage 114*a* and which is in a position beneath the ionographic print head 136. Arranged transversely with respect to the lines 154 are finger electrodes 156 which are so connected that they generate or do not generate charge carriers, in dependence on the program containing items of digital image information. Charge carriers of the desired polarity, which are indicated by the points or small circles 158 in FIG. 5, pass the screen electrode 164 and are applied to the surface to be decorated as long as there is a voltage difference between the finger electrodes 156 and the surface 160 of the grounded base electrode 162. The article 116 is provided at its top side with a dielectric layer 163 on which the charge pattern is formed. As soon as, in the course of transfer of the charge carriers 158 on to the surface, the charge thereof has reduced at the respective location to such an extent that there is no longer any voltage difference between the print head 120 and the article 116, the further feed flow of charge carriers 158 automatically ceases.

The function of the screen electrode 164 which is arranged at the underside of the ionographic print head 120 is to give rise to the generation of a stream only of charged particles with the desired polarity, insofar as it gives rise to the existence of an electrical field which has the effect that only ions of the desired polarity pass the respective opening 166 in a direction towards the subjacent article which is to be decorated, with the concomitant formation of a latent charge pattern.

FIG. 5 also shows two different operating conditions of the ionographic print head.

In FIG. 5, the pair of finger electrodes 156 operatively associated with the opening 166 which is at the left is switched on so that a stream of charge carriers 158 flows towards the article 116 which is beneath the opening 166. The two finger electrodes 156 associated with the opening 166 which are at the right in FIG. 5 are switched off, that is to say they receive such a low voltage that no stream of charge particles flows towards the article 166 below that opening.

The arrangement of the openings 166 and thus the finger electrodes 156 which are arranged in pairs in the ionographic print head 120 substantially corresponds to the arrangement of the nozzles 27 of the inkjet print head 20 described hereinbefore with reference to FIGS. 1 through 3 so that the embodiment of FIGS. 4 and 5 also involves for example relative orientation between an article 116 and a print head 120 by suitable activation of the finger electrodes 156 associated with the corresponding openings 166 in question. Accordingly, the spacings between the openings 166 or the associated finger electrodes 156 which are respectively present in pairs in the print head 120 are also such that if necessary a charge pattern is produced on the dielectric layer of the article 116, which results in printing ink being applied in a closed, continuous and uninterrupted coating.

After treatment of the article 116 in the print station I which has the ionographic print head 120, the transportation carriage 114*a* carrying the article 116 is transported in the direction of the arrow indicated at 134 in FIG. 4 into the further station Ia which is disposed directly downstream of the station I. It is in that station Ia that the operation of applying the printing ink for example in the form of toner is effected in the usual manner; the particles of the toner are charged in the opposite manner to the charge carriers on the surface of the article 116 so that the particles cling to the surface 160 of the article 116 as soon as that surface had been charged up in the above-described manner. Thereafter, the carriage 114*a* with the article 116 thereon can be transported into the next station Ib which includes a device diagrammatically indicated at 170 which is operable to remove superfluous ink particles and possibly also residual charges which have still remained on the surface of the article.

The article 116 on its carrier 114*a* then moves to the station II which also has an ionographic print head 120. In the station II, a second latent pattern is applied to the article 116 in the above-described manner. That second latent pattern generally represents a supplement to the first latent pattern or the print image corresponding thereto. Arranged downstream of the station II in the direction of transportation movement 134 are stations IIa and IIb in which treatments corresponding to those implemented in the station IIa and Ib are also effected.

Although in the description of the embodiments illustrated in the drawing, reference has always been made to decorating CDs, it will be appreciated that it is also possible for other articles to be printed upon or decorated, by carrying into effect the teaching in accordance with the present invention. Thus there is the possibility of decorating hollow bodies of plastic material, for example bottles, using an inkjet head or an ionographic print head. When dealing with articles of that kind which are relatively easily deformable, that would afford the advantage that there is no need to take particular steps to impart the necessary stiffness to the article during the printing operation. Such measures are usually required for example when carrying out a conventional printing process such as a screen printing process or an offset printing process, by for example putting the interior of the hollow body under an increased pressure during the printing procedure so that the hollow body does not suffer from unacceptable deformation under the effect of the forces applied thereto by the screen printing stencil or the offset printing blanket cylinder. That danger does not arise in the case of the contact-less printing operation in accordance with the invention so that it also enjoys noticeable advantages in that respect over the state of the art.

It will be noted once again at this point that, when reference is made hereinbefore to the articles being decorated, that term is not intended to constitute a limitation in that respect. On the contrary as noted above the term decoration is to be interpreted in its broadest sense, for example also in such a way that not just images but any items of description, other text, digits, numbers, graphics and the like are embraced by that term.

It will be appreciated that the above-described process and apparatus according to the invention have been set forth solely by way of example and illustration of the principles of the invention and that various other modifications and alterations may be made therein without thereby departing from the spirit and scope of the invention.

What is claimed is:

1. A process for decorating an article comprising:

applying printing ink to the article carried by a holder in dependence on a program which contains digitised image information in dot form from nozzles, individual dots together forming at least a partial print image as decoration on the article;

moving said holder by means of a linear motor along a transportation path through at least one print station provided with a print head having the nozzles, the holder being carried by a transportation carriage which is part of the linear motor; and controlling the nozzles in dependence on the program, at least a part of the nozzles being actuated in accordance with the program during the transportation movement of the article.

2. A process as set forth in claim 1 wherein the program for controlling the print head is called up in dependence on the transportation movement of the article.

3. A process as set forth in claim 1 wherein the transportation movement of the article is regulated during the printing operation in dependence on execution of the program for controlling the print head.

4. A process as set forth in claim 1 wherein the holder is carried by a primary portion of the linear motor.

5. A process as set forth in claim 1 wherein the holder is carried by a secondary portion of the linear motor.

6. A process as set forth in claim 1 wherein the nozzles of the print head are arranged in a row configuration transversely with respect to the transportation direction and the nozzles of at least one row of nozzles extend over a length which is at least equal to the width of the region of the article that is to be provided with the decoration, in transverse relationship to the transportation direction thereof.

7. A process as set forth in claim 6 wherein the position of the article on the holder is detected and the actual position ascertained in that way is compared in a computer to a stored reference position and the length of the at least one row of nozzles of the print head is greater than the greatest width of the portion of the article that is to be decorated, in transverse relationship to the transportation direction thereof, and in dependence on the result of the comparison between the actual position and the reference position of the article, said nozzles of the at least one row of nozzles which correspond to the respective position of the article are brought into operation.

8. A process as set forth in claim 1 wherein a length measuring system arranged along at least a part of the transportation path of the at least one carriage is read by a sensor disposed on the carriage carrying the article, in order thereby to detect at least one of the parameters consisting of position and speed of the carriage.

9. A process as set forth in claim 8 wherein the length measuring system is an incremental system which triggers in the sensor pulses which are passed to a computer.

10. A process as set forth in claim 9 wherein the length measuring system has a plurality of pulse generators for producing the pulses and the spacing of the pulse generators from each other in the length measuring system is not more than $1\mu$.

11. A process as set forth in claim 1 wherein the transportation movements of the at least one transportation carriage carrying an article are controlled at least outside the print station at least in part in dependence on a program.

12. A process for decorating an article comprising:

applying printing ink to the article carried by a holder in dependence on a program which contains digitised image information in dot form from nozzles, individual dots together forming at least a partial print image as decoration on the article, the position of the article on the holder having been detected and the actual position ascertained in that way having been compared in a computer to a stored reference position and in dependence on the result of that comparison operation the print head having been moved transversely with respect to the direction of transportation movement of the article in order to adapt the position thereof to the actual position of the article;

moving said holder by means of a linear motor along a transportation path through at least one print station provided with a print head having the nozzles; and controlling the nozzles in dependence on the program, at least a part of the nozzles being actuated in accordance with the program during the transportation movement of the article.

13. A process for decorating an article comprising:

applying printing ink to the article carried by a holder in dependence on a program which contains digitised image information in dot form from nozzles, individual dots together forming at least a partial print image as decoration on the article;

moving said holder by means of a linear motor along a transportation path through at least one print station provided with a print head having the nozzles;

controlling the nozzles in dependence on the program, at least a part of the nozzles being actuated in accordance with the program during the transportation movement of the article; and successively printing upon the article in at least first and second print stations which are arranged at a spacing in succession in the direction of movement of the article along the transportation path.

14. A process as set forth in claim 13 wherein the printing ink is dried on the article after passing through a print station before fresh printing is applied to the article in a following print station.

15. Apparatus for decorating an article using a process in which printing ink is applied to the article in dot form in dependence on a program which includes digitised image information, individual dots together forming at least a partial print image, the Apparatus comprising:

at least one print station;

at least one print head at said print station and controllable by the program and having a plurality of individual nozzles; means for actuation of the nozzles under pulse control in accordance with the program to apply ink to form the decoration;

at least one transportation path through said print station;

a holder for carrying a respective article to be decorated and displaceable along the transportation path;

a linear motor for transporting the holder along the transportation path; and a transportation carriage carrying the holder, the carriage comprising a primary portion of the linear motor.

16. Apparatus as set forth in claim 15 further comprising:

means for mounting the print head movably in transverse relationship with the transportation path in order thereby to adapt the position of the print head to the actual position of an article to be printed.

17. Apparatus as set forth in claim 15 wherein in at least one print station a plurality of rows of nozzles are arranged in succession in the transportation direction and the nozzles of the individual rows are arranged in displaced relationship transversely with respect to the transportation direction relative to the nozzles of at least one other row.

18. Apparatus as set forth in claim 15 wherein in the transportation direction of the articles to be printed upon arranged downstream of at least one print station is a station in which printing ink applied to a respective article is dried.

19. Apparatus for decorating an article using a process in which printing ink is applied to the article in dot form in dependence on a program which includes digitised image information, individual dots together forming at least a partial print image, the Apparatus comprising:

at least one print station;

at least one print head at said print station and controllable by the program and having a plurality of individual nozzles;

means for actuation of the nozzles under pulse control in accordance with the program to apply ink to form the decoration;

at least one transportation path through said print station;

a holder for carrying a respective article to be decorated and displaceable along the transportation path;

a linear motor for transporting the holder along the transportation path; and a transportation carriage carrying the holder, the carriage comprising a secondary portion of the linear motor.

20. Apparatus for decorating an article using a process in which printing ink is applied to the article in dot form in dependence on a program which includes digitised image information, individual dots together forming at least a partial print image, the Apparatus comprising:

at least one print station;

at least one print head at said print station and controllable by the program and having a plurality of individual nozzles;

means for actuation of the nozzles under pulse control in accordance with the program to apply ink to form the decoration;

at least one transportation path through said print station;

a holder for carrying a respective article to be decorated and displaceable along the transportation path;

a linear motor for transporting the holder along the transportation path;

a transportation carriage carrying the holder; and means operable in dependence on the actual position of the article to actuate said nozzles of the respective row which correspond to the respective position of the region of the article to be printed upon;

the nozzles of the print head being arranged in rows extending transversely with respect to the transportation direction of the transportation carriage, and the extent of at least one of said rows being greater than the width of the article region that is to be printed upon in transverse relationship to the direction of movement of the article.

21. Apparatus for decorating an article using a process in which printing ink is applied to the article in dot form in dependence on a program which includes digitised image information, individual dots together forming at least a partial print image, the Apparatus comprising:

at least one print station;

at least one print head at said print station and controllable by the program and having a plurality of individual nozzles;

means for actuation of the nozzles under pulse control in accordance with the program to apply ink to form the decoration;

at least one transportation path through said print station;

a holder for carrying a respective article to be decorated and displaceable along the transportation path;

a linear motor for transporting the holder along the transportation path;

a transportation carriage carrying the holder;

a length measuring system arranged along at least a portion of the transportation path of the at least one carriage of the linear motor; and a sensor for reading the length measuring system, the sensor being mounted to the carriage carrying the article in order thereby to detect at least one of the parameters consisting of position and speed of the carriage.

22. Apparatus as set forth in claim 21 wherein the length measuring system comprises a plurality of pulse generators for triggering pulses in the sensor, the spacing of the pulse generators from each other being less than $1\mu$.

23. Apparatus for decorating an article using a process in which printing ink is applied to the article in dot form in dependence on a program which includes digitised image information, individual dots together forming at least a partial print image, the Apparatus comprising:

at least one print station;

at least one print head at said print station and controllable by the program and having a plurality of individual nozzles;

means for actuation of the nozzles under pulse control in accordance with the program to apply ink to form the decoration;

at least one transportation path through said print station;

a holder for carrying a respective article to be decorated and displaceable along the transportation path;

a linear motor for transporting the holder along the transportation path; and a transportation carriage carrying the holder;

at least first and second print stations arranged in succession at a spacing from each other in the direction of movement of the carriage along the transportation path.

* * * * *